US005237840A

United States Patent [19]

Benito

[11] Patent Number: 5,237,840

[45] Date of Patent: Aug. 24, 1993

[54] ELECTROMECHANICAL DEVICE FOR SELECTING THE NEEDLE ACTUATING SINKERS IN AN AUTOMATIC FLAT KNITTING MACHINE

[75] Inventor: Stoppazzini Benito, Sala Bolognese, Italy

[73] Assignee: EMM S.R.L., Bologna, Italy

[21] Appl. No.: 941,545

[22] Filed: Sep. 8, 1992

[30] Foreign Application Priority Data

Sep. 20, 1991 [IT] Italy ..... B091U000168

[51] Int. Cl.[5] ..... D04B 15/66

[52] U.S. Cl. ..... 66/75.2; 66/75.1

[58] Field of Search ..... 66/75.1, 75.2, 78

[56] References Cited

U.S. PATENT DOCUMENTS 4,534,186 8/1985 Stoppazzini ..... 66/75.2
4,554,802 11/1985 Goller et al. ..... 66/75.2 X
4,660,391 4/1987 Schimko ..... 66/75.2
5,076,110 12/1991 Nakamori ..... 66/75.2 X

*Primary Examiner*—Clifford D. Crowder
*Assistant Examiner*—John J. Calvert
*Attorney, Agent, or Firm*—McAulay Fisher Nissen Goldberg & Kiel

[57] ABSTRACT

In a selection device there is an electromagnet, secured to a plate integral with a carriage of an automatic knitting machine, and the mobile armature of the electromagnet carries a cylindrical element having a free head-rounded and inserted in a concave seat made in a head of an operative assembly, while the other head of the operative assembly integral with a selection member is guided slidingly by the plate. This assembly is stabilized by elestic means designed also to contrast the movement of the assembly when it is subjected to the action of the armature. Enabling the electromagnet causes the selection member to locate at the selection position S.

6 Claims, 2 Drawing Sheets

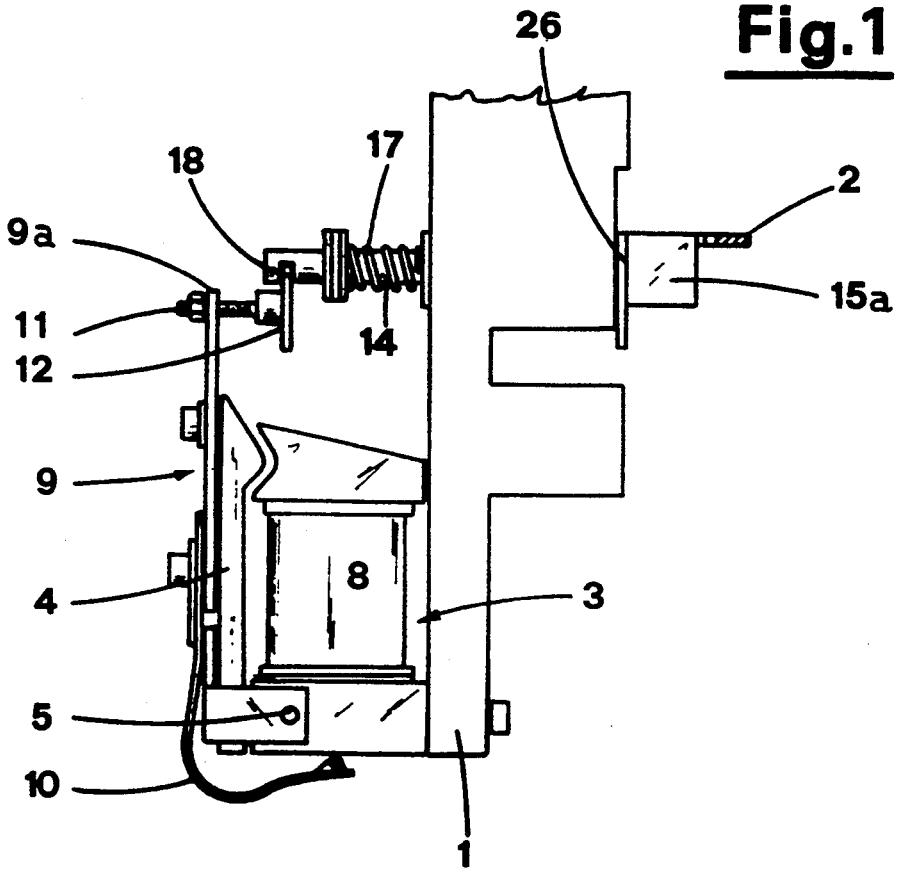
PRIOR ART

H2
31a
21a
H1
30
P
31
33a
33b
36
21
IV
Z
S
I
35
20b
20a
22
26
25
25a
24
N
23
25b
23a
R
34
20
33b
30
31
III
35
33
32
40
50
37
38
28
39
27
29
36
85

ELECTROMECHANICAL DEVICE FOR SELECTING THE NEEDLE ACTUATING SINKERS IN AN AUTOMATIC FLAT KNITTING MACHINE

BACKGROUND OF THE INVENTION

This invention concerns an electromechanical device for selecting the needle actuating sinkers in an automatic flat knitting machine.

DESCRIPTION OF THE PRIOR ART

It is known that in automatic flat knitting machines every needle bed has equidistant grooves.

In the upper part of each groove there is inserted a needle while in the lower part of the same groove there is a sinker designed, if shifted, to actuate the needle above it.

This sinker has at least a lower and an upper butt, the latter being designed to be struck by a proper selection member when this latter is enabled.

When the selection member strikes the upper butt, the sinker is shifted upwards, so that the lower butt is positioned on the way of the fixed cam mounted on the carriage of the machine. The fixed cam then strikes the lower butt and the sinker if further shifted upwards, thus actuating the needle.

With the recent use of electronic units designed to control the machine in accordance with a preset cycle, some of the constructors of the automatic flat knitting machines have mounted electromagnets with sliding armature as selection members.

When the armature protrudes out of the relative seat, it strikes directly, or indirectly with the interposition of suitable linkages, the aligned upper butt of the sinker that is designed to actuate, when shifted, the correspondent needle.

The Applicant has invented an original electromechanical device for selecting the needle actuating sinkers, covered by the U.S. Pat. No. 4,534,186.

Such device (see FIG. 1) includes an electromagnet 3, secured to a plate 1 provided in said carriage, the armature 4 of which is journaled in 5 to the relative magnetic core.

An elastic means 10 acts on the armature 4 in contrast with the magnetic force, while a strip 9 is fixed to the armature and protrudes in respect of it.

A cylindrical element 11 has one end fixed perpendicularly to the portion 9*a* of the strip 9 protruding from the armature, and the other end provided with a small disk 12; a stem 14 passes freely through a hole made in of the plate 1, and has the end adjacent to the side of the plate opposite to the disk, equipped with a member 15*a* for selecting a sinker 2, and moreover, with a transversal striker plate 26 that determines, when it is abutting on the said plate 1, the inoperative position of the same selection member 15*a*.

The stem has, at the side of the disk, a slit 18 designed to receive a portion of the edge of the disk; further elastic means 17 act on the stem 14 in contrast with the action carried out on the latter by the disk 12 as a consequence of the excitation of the bobbin 8 of the electromagnet 3.

This device has appeared to be reliable and functional, but it presents a limitation as far as it concerns the number of selections practicable in a time unit.

This fact is a consequence of the inertia of the mobile parts (armature 4, strip 9, cylindrical element 11, disk 12, stem 14) and of the relative complexity of the means designed to operate the selection member 15*a*.

SUMMARY OF THE INVENTION

The object of the invention is to propose a device performing the same functions as the one described in the U.S. Pat. No. 4,534,186 and shaped in such a way that it is possible to perform a number of selections in a time unit considerably larger than the one obtained with known devices, all this being obtained by a combination of a limited number of elements of simple realization and easy assembling.

A further object of the invention is to provide a device that not only satisfies the above requirement, but that is also obtained with a lower cost in respect of the device illustrated in the cited U.S. Patent.

The above mentioned objects are achieved in with an automatic flat knitting machine, in which there is an electromechanical device for selecting the needle actuating sinkers, each of said sinkers being provided with at least a lower butt, and an upper butt, with said upper butt designed, when it is struck by a selection member, to make the relative sinker to shift upwards so as to locate the lower butt on the run of a fixed cam carried by the carriage of the machine and designed to strike said lower butt for further raising the said sinker and actuating the associated needle.

The device comprises:

- an electromagnet, secured to the internal face of a plate integral with said carriage and including a magnetic core;
- a support integral with said magnetic core;
- a mobile armature, journaled to said support integral and protruding laterally with respect to said electromagnet, the oscillation of said mobile armature toward outside being limited by said support;
- a cantilever cylindrical element secured to the portion of said armature protruding from the electromagnet and having the relative free head turned toward the internal face of said plate;
- an operative assembly, oriented perpendicularly with respect to said plate, provided at one end with a selection member;
- a through guide hole, made in said plate, for slidingly receiving and guiding said selection member, so that said member protrudes partially from the external face of said plate, with said assembly subjected at the other end to the action of the free head of the said cylindrical element;
- a first striker plate and a second striker plate, said striker plates being designed to prevent the selection member from coming out of the relative hole, and to define, as a result of their striking against means fixed to said plate, the inoperative position I and the selection position S for the same selection member with respect to the external face of the plate;
- elastic means connected with said operative assembly, designed to stabilize axially the latter and to contrast the action performed by said cylindrical element on the same assembly because of the enabling of the electromagnet.

BRIEF DESCRIPTION OF THE DRAWINGS

The features of the invention are made evident in the following, with reference to the accompanying drawings, in which:

FIG. 1 shows a lateral view of the device described in the already quoted U.S. Pat.;

DESCRIPTION OF THE PREFERRED EMBODIMENT

Figures 2, 3A, 3B, 4:
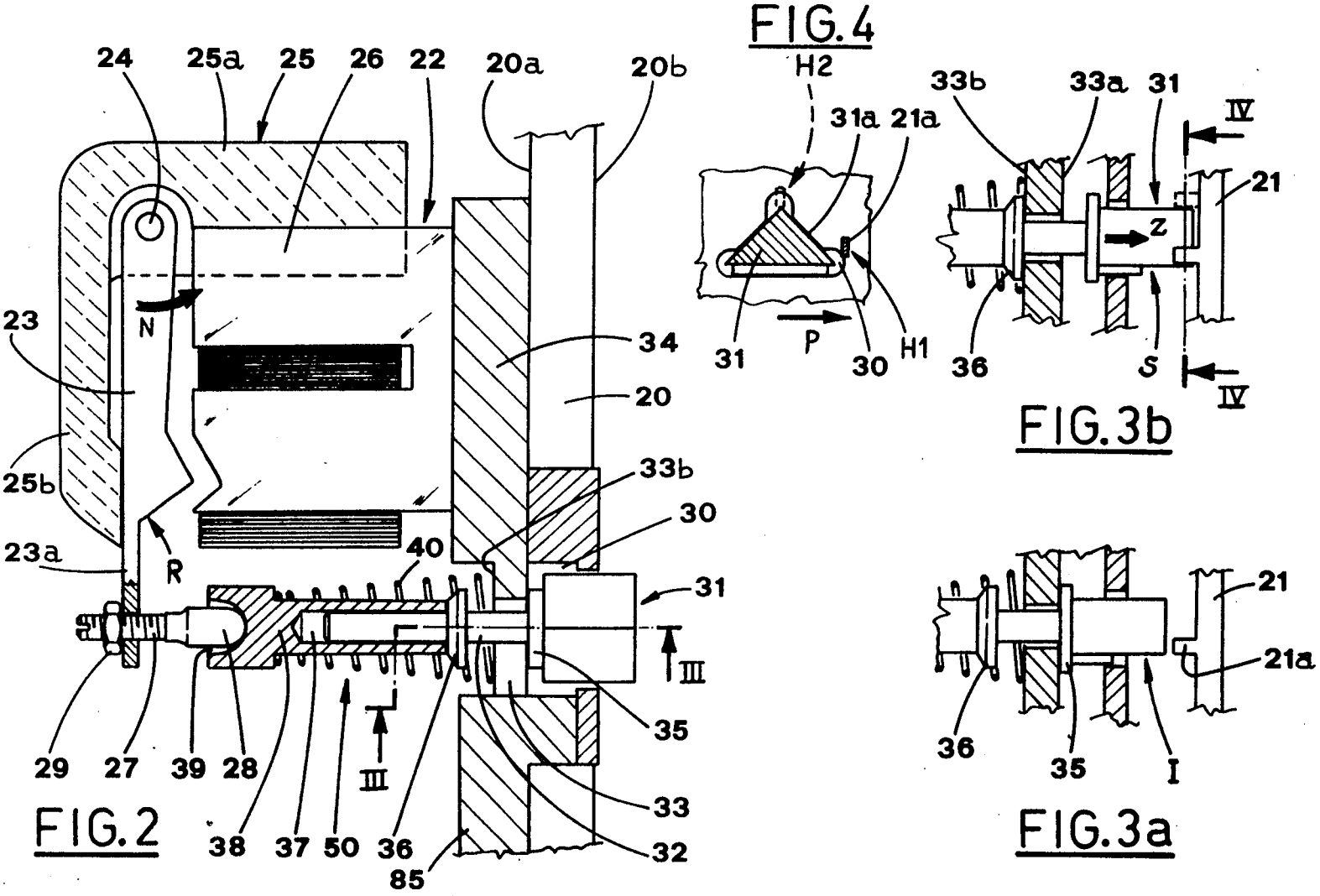
FIG. 2 shows, in the enlarged scale, a lateral view, partly sectioned, of the device being the object of the invention.
FIGS. 3*a*, 3*b* show the sectional views III—III of FIG. 2, with the selection member in the inoperative and operative positions, respectively.
FIG. 4 show the sectional view IV—IV of FIG. 3.

With reference to the said FIGS. 2, 3*a*, 3*b*, 4, the reference numeral 20 indicates a plate secured to the carriage (not illustrated) of an automatic knitting machine, and 21 indicates a selection sinker.

An electromagnet 22 is secured to the internal face 20*a* of the plate 20, and the mobile armature 23 of the electromagnet is journaled, in 24, to an angular support 25.

A wing 25*a* of the angular support is fixed to a leg of the magnetic core 26 of the electromagnet 22, while the other wing 25*b* is shifted in respect of the heads of the legs of the magnetic core that are connected with the armature 23, so as to set a stop for the oscillation toward outside of the latter.

In particular, the armature 23 protrudes, with one portion 23*a*, in respect of the electromagnet 22.

A cantilever cylindrical element 27 is fixed perpendicularly to the portion 23*a*, while the free rounded head 28 of it is turned towards the face 20*a*; a nut 29 allows to regulate the distance between the head 28 and the portion 23*a* of the armature.

A through hole 30 is made in the plate 20, in a position almost centered in respect to the axis of the element 27 (FIG. 4), for housing and guiding a selection member 31 with triangular section.

The member 31 is carried by a stem 32 that passes freely through a slot 33 made in a plaque 34 secured to the internal face 20*a* of the plate 20.

This slot is laterally delimited by a block 85 fixed to the plate 20 (FIG. 2).

The stem 32 is provided with a first striker plate 35 adjacent to the member 31, and with a second striker plate 36; the second striker plate 36 defines the depth of the forced insertion of the stem in a hole 37 made in a tube 38 (of synthetic resin); the free head of the tube 38 features a concave seat 39.

In the tube 38 there is made a shoulder that acts as a stop for an end of a frustoconical spring 40 (coaxial with the same tube).

The other end of the spring rests against the outer face 33*b* of the edge of the slot 33.

The striker plates 35, 36 prevent the member 31 from coming out of the relative hole 30 and, at the same time, individuate, as a consequence of their striking against the internal and external faces 33*a*, 33*b* of the edge delimiting the slot 33, the extent of the stroke for the member 31, with respect to the the plate 20.

With the striker plate 35 abutting on the external face 33*a* of the edge of the slot 33 the inoperative position I is set, while with the striker plate 36 abutting on the internal face 33*b* of the edge of the slot 33 the selection position S is set (FIGS. 3*a*, 3*b*).

The longitudinal extension of the operative assembly 50, formed by the stem 32 (with the relative member 31) and by the tube 38, as well as the action of the spring 40 on the same assembly enable anyway the free connection between the seat 39 and the head 28.

The spring 40, in combination with the guide action performed by the hole 30 on the member 31, stabilizes and maintains the perpendicular direction of the assembly 50 in respect the plate 20.

In the resting state (FIG. 2) the action of the spring makes the striker plate 35 to abut on the edge of the slot 33, defining in this way the inoperative position I for the member 31 (FIG. 3*a*), and sets the resting position R for the armature 23.

Enabling the electromagnet 22 causes the rotation, according to the direction N, of the armature 23, with the consequent shifting of the assembly 50 in direction Z until the striker plate 36 abuts on the edge of the slot 33 (selection position S: FIG. 3*b*).

During this phase the spring 40 contrasts elastically the stress provoked by the element 27 on the assembly 50.

The head 28 of the element 27 describes an arc when the armature rotates about the pin 24; this does not provoke transversal stresses on the assembly 50 because such head 28 "oscillates" in the seat 39 in which it is inserted.

In the following the operation of the above described device will be described.

As already stated, the plate 20 is integral with the carriage which translates perpendicularly with respect to the sinkers 21 (only one of which is illustrated in the FIGS. 3*a*, 3*b*, 4).

With the electromagnet disabled, the butt 21*a* of the sinker 21 is not struck by the member 31, because the member 31 is in the inoperative position I which is internal with respect to the butt 21*a* (FIG. 3*a*).

If, on the contrary, the electromagnet is enabled, the sinker 21 is shifted upwards, because the member 31 is in the position S (FIG. 3*b*) and strikes with the incline 31*a* (supposing the cited carriage be moved in the direction P, FIG. 4) the butt 21*a* that is shifted from the lowered position H1 to the raised position H2 (FIG. 4).

Obviously, the electromagnet remains enabled until this raising is completed.

Disabling of the electromagnet makes the conditions of the FIGS. 2, 3*a* being restored.

In other words, the armature of the electromagnet moves the operative assembly 50 by means of the only component, that is not bound rigidly to the same assembly, i.e. the element 27; this fact brings advantages as far as the motion of the elements that are moved is concerned, the whole bringing to an increase of the number of selections (of the sinker 21) in the time unit, with respect to the prior art.

The simplicity of the components making up the proposed device reduces the costs of the realization and of the assembling as well.

It is obvious that what has been described above is only illustrative, therefore all possible constructive variants are within the protection of the innovation as claimed in the following.

What is claimed is:

1. An electromechanical device mounted on an automatic flat knitting machine for selecting needle actuating sinkers, the machine having a carriage, each of the sinkers having a lower butt and an upper butt, the upper butt, when struck by a selection member, causing the sinker to shift upward, so as to locate the lower butt on a run of a fixed cam carried by the carriage, the cam being designed to strike the lower butt to further raise the sinker and to actuate an associated needle, said device comprising:

an electromagnet having a magnetic core, said electromagnet secured to an internal face of a plate, said plate being integral with the carriage;

a support integral with said magnetic core;

a mobile armature journaled to said support, said armature having a portion protruding laterally with respect to said electromagnet, oscillation of said armature in an outward direction being limited by said support;

a cantilever cylindrical element secured to said protruding portion of said armature, said cylindrical element having a free head turned toward the internal face of the plate, the plate having a through guide hole for slidably receiving and guiding the selection member so that the member protrudes partially from the external face of the plate; and, an operative assembly oriented perpendicularly with respect to said plate having a stem, one end of which carries the selection member, said stem being inserted in and protruding through the guide hole in said plate;

first and second striker plates mounted on said stem to retain said stem within the guide hole, said striker plates defining an inoperative position and a selection position for the selection member with respect to an external face of the plate a tube, having through one side an axial hole, coupled at that side to a portion of the stem external of the second striker plate, a head of the tube opposite to said second striker plate abutted to a head of the cylindrical element, a shoulder provided externally on the tube, elastic means positioned between said shoulder and said internal face of said plate for biasing the selection member into said inoperative position, energizing said electromagnet overcoming the bias of said elastic means to move said selection member to said selection position.

2. The device according to claim 1 wherein said tube head has a concave seat in which the free head of the cylindrical element is inserted freely.

3. The device according to claim 2 wherein said free head is rounded.

4. The device according to claim 1 wherein a portion of said operative assembly situated between said striker plates is located within a slot made in a plaque secured to the internal face of the plate, the internal and external faces of the slot defining stops for the striker plates.

5. The device according to claim 1, wherein said support is made of synthetic resin.

6. The device according to claim 1, wherein said tube is made of synthetic resin.

* * * * *